US008008534B2

(12) United States Patent
Petri et al.

(10) Patent No.: US 8,008,534 B2
(45) Date of Patent: Aug. 30, 2011

(54) LIQUID PHASE HYDROPROCESSING WITH TEMPERATURE MANAGEMENT

(75) Inventors: John Anthony Petri, Palatine, IL (US); Peter Kokayeff, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 458 days.

(21) Appl. No.: 12/165,444

(22) Filed: Jun. 30, 2008

(65) Prior Publication Data

US 2009/0326289 A1 Dec. 31, 2009

(51) Int. Cl.
*C10G 51/02* (2006.01)

(52) U.S. Cl. ..... 585/263; 208/46; 208/49

(58) Field of Classification Search ..... 585/263; 208/142

See application file for complete search history.

(56) References Cited

U.S. PATENT DOCUMENTS

| | | | | |
|---|---|---|---|---|
| 2,578,704 | A | 12/1951 | Houdry | |
| 2,878,179 | A | 3/1959 | Hennig | |
| 2,943,999 | A | 7/1960 | Moore | |
| 3,072,465 | A | 1/1963 | Benichou et al. | |
| 3,128,242 | A | 4/1964 | Bergstrom et al. | |
| 3,130,006 | A | 4/1964 | Rabo et al. | 23/110 |
| 3,130,145 | A | 4/1964 | Buckhannan | |
| 3,142,545 | A | 7/1964 | Raarup et al. | |
| 3,154,481 | A | 10/1964 | Brooks | |
| 3,328,290 | A | 6/1967 | Hengstebeck | |
| 3,623,974 | A | 11/1971 | Mounce et al. | |
| 3,668,112 | A | 6/1972 | Parker et al. | 208/89 |
| 3,720,602 | A * | 3/1973 | Riley et al. | 208/217 |
| 3,730,880 | A | 5/1973 | Van der Toorn et al. | |
| 4,218,338 | A | 8/1980 | Huin et al. | |
| 4,363,718 | A | 12/1982 | Klotz | 208/110 |
| 4,419,220 | A | 12/1983 | LaPierre et al. | |

(Continued)

FOREIGN PATENT DOCUMENTS

EP 0225053 A1 10/1987

(Continued)

OTHER PUBLICATIONS

Schmitz, C. et al, "Deep desulfurization of diesel oil: Kinetic studies and process-improvement by the use of a two-phase reactor with pre-saturator," Chemical Engineering Science, vol. 59, No. 14, 2004, pp. 2821-2829.

(Continued)

*Primary Examiner* — Glenn A Caldarola
*Assistant Examiner* — Michelle L Stein
(74) *Attorney, Agent, or Firm* — James C Paschall

(57) ABSTRACT

A method of hydroprocessing hydrocarbons is provided using a substantially liquid-phase reactor having first and second catalyst beds with a heat transfer section positioned therebetween. The first and second catalyst beds and the heat transfer section are combined within the same reactor vessel. Each catalyst bed having an inlet temperature and an exit temperature and having a hydroprocessing catalyst therein with a maximum operating temperature range. The method hydroprocesses the hydrocarbons and removes sufficient heat from the hydrocarbons using the heat transfer section so that the exit temperature of the hydrocarbons existing the first catalyst bed is substantially maintained below the maximum operating temperature range of the hydroprocessing catalysts in the first bed and, at the same time, also providing the hydrocarbons to the second catalyst bed at the inlet temperature so that the exit temperature of the hydrocarbons at the exit of the second catalyst bed also does not exceed the maximum operating temperature range of the hydroprocessing catalyst in the second bed.

12 Claims, 2 Drawing Sheets

U.S. PATENT DOCUMENTS

| | | | | |
|---|---|---|---|---|
| 4,501,926 | A | 2/1985 | LaPierre et al. | |
| 4,554,065 | A | 11/1985 | Albinson et al. | |
| 4,555,325 | A | 11/1985 | Wolowski et al. | |
| 4,676,887 | A | 6/1987 | Fischer et al. | 208/61 |
| 4,678,764 | A | 7/1987 | Le et al. | |
| 4,683,214 | A | 7/1987 | Angevine et al. | |
| 4,689,138 | A | 8/1987 | Miller | |
| 4,738,766 | A | 4/1988 | Fischer et al. | 208/68 |
| 4,746,495 | A | 5/1988 | Mingaud et al. | |
| 4,788,378 | A | 11/1988 | Chang et al. | |
| 4,789,457 | A | 12/1988 | Fischer et al. | 208/68 |
| 4,828,677 | A | 5/1989 | Fischer et al. | 208/89 |
| 4,855,530 | A | 8/1989 | LaPierre et al. | |
| 4,859,311 | A | 8/1989 | Miller | |
| 4,867,862 | A | 9/1989 | Ziemer | |
| 4,919,789 | A | 4/1990 | Fischer et al. | 208/61 |
| 4,921,594 | A | 5/1990 | Miller | |
| 4,943,366 | A | 7/1990 | Fischer et al. | 208/68 |
| 4,954,241 | A | 9/1990 | Kukes et al. | |
| 4,960,504 | A | 10/1990 | Pellet et al. | |
| 4,962,269 | A | 10/1990 | LaPierre et al. | |
| 5,082,986 | A | 1/1992 | Miller | |
| 5,114,562 | A | 5/1992 | Haun et al. | |
| 5,135,638 | A | 8/1992 | Miller | |
| 5,149,421 | A | 9/1992 | Miller | |
| 5,246,566 | A | 9/1993 | Miller | |
| 5,282,958 | A | 2/1994 | Santilli et al. | |
| 5,403,469 | A | 4/1995 | Vauk et al. | |
| 5,403,470 | A | 4/1995 | Kokayeff et al. | 208/212 |
| 5,527,448 | A | 6/1996 | Morel et al. | 208/211 |
| 5,718,820 | A | 2/1998 | Morel et al. | 208/15 |
| 5,720,872 | A | 2/1998 | Gupta | |
| 5,833,837 | A | 11/1998 | Miller | |
| 5,904,835 | A | 5/1999 | Thakkar | |
| 5,976,351 | A | 11/1999 | Apelian et al. | |
| 5,980,729 | A | 11/1999 | Kalnes et al. | |
| 6,036,844 | A | 3/2000 | Gupta et al. | |
| 6,106,694 | A | 8/2000 | Kalnes et al. | |
| 6,123,835 | A | 9/2000 | Ackerson et al. | 208/213 |
| 6,200,462 | B1 | 3/2001 | Cash et al. | 208/89 |
| 6,217,746 | B1 | 4/2001 | Thakkar et al. | |
| 6,221,239 | B1 | 4/2001 | Morel et al. | |
| 6,294,080 | B1 | 9/2001 | Thakkar et al. | 208/100 |
| 6,387,245 | B1 | 5/2002 | Kalnes et al. | |
| 6,402,935 | B1 | 6/2002 | Kalnes | |
| 6,428,686 | B1 | 8/2002 | Ackerson et al. | 208/213 |
| 6,444,116 | B1 | 9/2002 | Galiasso et al. | 208/58 |
| 6,497,810 | B1 | 12/2002 | Laccino et al. | |
| 6,497,813 | B2 | 12/2002 | Ackerson et al. | 208/311 |
| 6,627,778 | B2 | 9/2003 | Xu et al. | |
| 6,638,419 | B1 | 10/2003 | Da Silva et al. | 208/208 R |
| 6,645,371 | B2 | 11/2003 | Vuillemot et al. | |
| 6,689,273 | B1 | 2/2004 | Kalnes et al. | |
| 6,702,935 | B2 | 3/2004 | Cash et al. | |
| 6,881,326 | B2 | 4/2005 | Ackerson et al. | 208/213 |
| 6,890,425 | B2 | 5/2005 | Ackerson et al. | 208/311 |
| 6,929,738 | B1 | 8/2005 | Riley et al. | |
| 7,041,211 | B2 | 5/2006 | Kalnes | |
| 7,074,320 | B2 | 7/2006 | Miller | |
| 7,078,439 | B2 | 7/2006 | Odueyungbo et al. | |
| 7,094,332 | B1 | 8/2006 | Kalnes et al. | 208/97 |
| 7,097,815 | B2 | 8/2006 | Dassori et al. | |
| 7,156,977 | B2 | 1/2007 | Wrisberg et al. | |
| 7,238,277 | B2 | 7/2007 | Dahlberg et al. | |
| 7,354,462 | B2 | 4/2008 | O'Rear | |
| 2002/0004621 | A1 | 1/2002 | Xu et al. | |
| 2002/0148755 | A1 | 10/2002 | Ackerson et al. | |
| 2004/0159582 | A1 | 8/2004 | Simmons et al. | |
| 2005/0010076 | A1 | 1/2005 | Wasserscheid et al. | 585/862 |
| 2005/0082202 | A1 | 4/2005 | Ackerson et al. | 208/213 |
| 2006/0118464 | A1 | 6/2006 | Kalnes | |
| 2006/0144756 | A1 | 7/2006 | Ackerson et al. | 208/108 |
| 2008/0023372 | A1 | 1/2008 | Leonard et al. | |
| 2008/0159928 | A1 | 7/2008 | Kokayeff et al. | |
| 2009/0095651 | A1 | 4/2009 | Leonard et al. | |
| 2009/0095652 | A1 | 4/2009 | Kokayeff et al. | |
| 2009/0095653 | A1 | 4/2009 | Kokayeff et al. | |
| 2009/0095655 | A1 | 4/2009 | Kokayeff et al. | |
| 2009/0095656 | A1 | 4/2009 | Kokayeff et al. | |
| 2009/0321310 | A1 | 12/2009 | Kokayeff et al. | |
| 2009/0321319 | A1 | 12/2009 | Kokayeff et al. | |
| 2010/0155294 | A1 | 6/2010 | Kokayeff et al. | |

FOREIGN PATENT DOCUMENTS

| | | |
|---|---|---|
| EP | 0 993 498 B1 | 8/2004 |
| WO | 9613563 A1 | 5/1996 |
| WO | 9626993 A1 | 9/1996 |
| WO | 0034416 A1 | 6/2000 |

OTHER PUBLICATIONS

Datsevitch, L. et al., "Improvement of the deep desulfurization of diesel fuel by pre-saturation and a recycle of the liquid phase," DGMK Tagungsber., 2003, pp. 321-328, Chemical Abstracts 140(15/16), Abstract No. 255917 (2004).

Gudde, N.J. et al., "Improving deep sulfur removal from motor fuels by the use of a pre-saturator and a liquid circuit," Chemie-Ingenieur-Technik, vol. 75, No. 8, 2003, p. 1040, and English language abstract (1 page).

Boesmann, A. et al., "Deep desulfurization of diesel fuel by extraction with ionic liquids," Chem. Commun., vol. 23, 2001, pp. 2494-2495, Chemical Abstracts 136(9/10), Abstract No. 153666 (2002).

Stratiev, D. et al., "Investigation on the effect of heavy diesel fraction properties on product sulphur during ultra deep diesel hydrodesulphurization," Erdol Erdgas Kohle, vol. 122, No. 2, 2006, pp. 59-60, 62-63, Urban Verlag Hamburg/Wien GmbH, Germany.

Gatte, R. et al., "Hydrogen processing. Hydrotreating. General Process.", National Petrochemical and Refiners Association, 1999 NPRA Question and Answer Session on Refining and Petrochemical Technology, Washington, D.C., pp. 140-158.

Johnson, T.E., "Weigh options for meeting future gasoline sulfur specifications," Fuel Technology & Management, vol. 7, No. 2, pp. 16,18 (Mar. 1997).

U.S. Appl. No. 11/300,007, filed Dec. 14, 2005, Leonard.

U.S. Appl. No. 12/495,601, filed Jun. 30, 2009, Petri.

Office Action dated Jun. 4, 2009 in U.S. Appl. No. 11/460,307, Leonard.

Applicants' Sep. 4, 2009 Response to the Jun. 4, 2009 Office Action in U.S. Appl. No. 11/460,307, Leonard.

Office Action dated Jun. 12, 2009 in U.S. Appl. No. 11/618,623, Kokayeff.

'Applicants' Sep. 11, 2009 Response to the Jun. 12, 2009 Office Action in U.S. Appl. No. 11/618,623, Kokayeff.

Office Action dated Dec. 15, 2009 in U.S. Appl. No. 11/872,084, Leonard.

Applicants' Mar. 15, 2010 Response to the Dec. 15, 2009 Office Action in U.S. Appl. No. 11/872,084, Leonard.

Office Action dated Oct. 5, 2009 in U.S. Appl. No. 11/872,312, Kokayeff.

Applicants' Jan. 5, 2010 Response to the Oct. 5, 2009 Office Action in U.S. Appl. No. 11/872,312, Kokayeff.

Office Action dated Apr. 12, 2010 in U.S. Appl. No. 11/872,312, Kokayeff.

Applicants' Jul. 1, 2010 Response to the Apr. 12, 2010 Office Action in U.S. Appl. No. 11/872,312, Kokayeff.

U.S. Appl. No. 12/495,574, filed Jun. 30, 2009, Petri.

Ronze, "Hydrogen solubility in straight run gasoil", Chemical Engineering Science 57 (2002) 547-553.

Wache, "Improved deep desulphurisation of middle distillates by a two-phase reactor with pre-saturator", Fuel 85 (2006) 1483-1493.

* cited by examiner

LIQUID PHASE HYDROPROCESSING WITH TEMPERATURE MANAGEMENT

FIELD OF THE INVENTION

The field generally relates to hydroprocessing of hydrocarbon streams and, more particularly, to hydroprocessing using substantially liquid-phase hydroprocessing.

BACKGROUND OF THE INVENTION

Petroleum refiners often produce desirable products such as turbine fuel, diesel fuel, middle distillates, naphtha, and gasoline boiling hydrocarbons among others by hydroprocessing a hydrocarbon feed stock derived from crude oil or heavy fractions thereof Hydroprocessing can include, for example, hydrocracking, hydrotreating, hydrodesulphurization and the like. Feed stocks subjected to hydroprocessing can be vacuum gas oils, heavy gas oils, and other hydrocarbon streams recovered from crude oil by distillation. For example, a typical heavy gas oil comprises a substantial portion of hydrocarbon components boiling above about 371° C. (700° F.) and usually at least about 50 percent by weight boiling above 371° C. (700° F.), and a typical vacuum gas oil normally has a boiling point range between about 315° C. (600° F.) and about 565° C. (1050° F.).

Hydroprocessing is a process that uses a hydrogen-containing gas with suitable catalyst(s) for a particular application. In many instances, hydroprocessing is generally accomplished by contacting the selected feed stock in a reaction vessel or zone with the suitable catalyst under conditions of elevated temperature and pressure in the presence of hydrogen as a separate phase in a three-phase system (i.e., hydrogen gas, a liquid hydrocarbon stream, and a solid catalyst). Such hydroprocessing systems are commonly undertaken in a trickle-bed reactor where the continuous phase throughout the reactor is gaseous.

In the trickle-bed reactor, a substantial excess of the hydrogen gas is present. In many instances, a typical trickle-bed hydrocracking reactor requires up to about 10,000 SCF/B of hydrogen at pressures up to 17.3 MPa (2500 psig) to effect the desired reactions. In these systems, because the continuous phase throughout the reactor is a gas-phase, large amounts of excess hydrogen gas are generally required to maintain this continuous phase. However, supplying such large supplies of gaseous hydrogen at the operating conditions needed for hydroprocessing adds complexity and capital and operating expense to the hydroprocessing system.

In order to supply and maintain the needed amounts of hydrogen, the resulting effluent from the trickle-bed reactor is commonly separated into a gaseous component containing hydrogen and a liquid component. The gaseous component is directed to a compressor and then recycled back to the reactor inlet to help supply the large amounts of hydrogen gas needed to maintain the continuous gaseous phase therein. Conventional trickle-bed hydrocracking units typically operate up to about 17.3 MPa (2500 psig) and, therefore, require the use of a high-pressure recycle gas compressor in order to provide the recycled hydrogen at necessary elevated pressures. Often such hydrogen recycle can be up to about 10,000 SCF/B, and processing such quantities of hydrogen through a high-pressure compressor adds complexity, increased capital costs, and increased operating costs to the hydroprocessing unit. In general, the recycle gas compressor represents about 15 to about 30 percent of the cost of a hydroprocessing unit.

Many reactions undertaken using hydroprocessing reaction zones, such as hydrodesulfurization, hydroisomerization, hydrodenitrification, hydrodeoxygenation, hydrocracking, and aromatic saturation to suggest but a few are exothermic and, therefore, result in a temperature rise of the hydrocarbon stream across the catalyst reaction bed. In many of the reactions, such as hydroisomerization, hydrotreating petroleum fractions containing a lower concentration of heteroatoms, hydrocracking in a second stage after severe hydrotreatment, where the consumed hydrogen can be relatively low, between about 50 and about 500 SCF/B, and the reactions can result in heat releases causing a temperature increase in excess of about 28 to 56° C. (50 to 100° F.). In other reactions, such as hydrotreating petroleum fractions containing higher concentration of heteroatoms, full conversion hydrocracking in a single stage, aromatic saturation of a highly aromatic petroleum fraction, the consumed hydrogen can be higher than about 500 SCF/B, and the heat release from such reactions may cause temperature increases in excess of about 37° C. (100° F.). In still other reactions, such temperature increases can result in the temperature of the hydrocarbons exceeding about 399° C. (750° F.) to about 427° C. (800° F.), which is generally unacceptable for the catalysts used in these reactions. In typical trickle bed reaction zones, the large amounts of recycle gas introduced into the inlet of the reactor helps manage unacceptable reactor temperature increases.

In some cases, it is desired to eliminate the costly recycle gas compressor by using a two-phase hydroprocessing system (i. e., a liquid hydrocarbon stream and solid catalyst). In these reaction systems, the continuous phase throughout the reactor is liquid rather than gas and, therefore, generally do not need a source from a high pressure recycle gas compressor. Such two-phase systems generally use only enough hydrogen dissolved in the liquid-phase to saturate the liquid in the reactor. However, it can be more difficult to manage the temperature profile in such reactors. Diluents added as recycle liquids or quench streams, can help manage temperatures, but these solutions can reduce the effectiveness of the hydroprocessing reactions as they tend to reduce the contact time between the unconverted oil and the catalysts resulting in less effective conversions to other products. Such diluents also may introduce other materials with the process that impact reaction rates and other vessels parameters.

SUMMARY OF THE INVENTION

A hydroprocessing reaction zone system and method of hydroprocessing hydrocarbons through that system are provided in which a hydrocarbonaceous feed of substantially liquid phase is processed throughout the hydroprocessing reaction zone. The temperatures of the process flow through the reaction zone are managed by least one internal heat transfer section positioned within the reaction vessel. In such configurations, the temperatures in the reaction zone can be effectively managed without the use of recycle gas, without additional added quench streams and, in most cases, even without additional added liquid recycle streams. The temperature controlled reaction zone further may be combined with a high pressure stream separation system to provide the further improved separation of the liquid and vapor phase of the hydroprocessed effluent. Such configurations and methods can be used to provide a compact hydroprocessing vessel and a simplified hyrdroprocessing system that includes internal temperature management control.

In one aspect, a liquid-phase reaction zone is provided where the liquid phase may include an amount of dissolved hydrogen and, in some cases, may be at least saturated with hydrogen. In other aspects, the substantially liquid phase, may include at least about 10 percent excess hydrogen above the hydrogen consumption requirements for the particular hydroprocessing reactions. The substantially liquid-phase reaction zone may include at least a first and a second catalyst bed with an integral heat transfer section disposed therebetween. The process flow from the first catalyst bed is received in the integral heat transfer section to exchange heat with a transfer medium (separate from the hydrocarbonaceous fluid) and which exits the reaction zone to the second catalyst bed.

The temperatures of the process flow into the first catalyst bed and the cooled flow into the second catalyst bed may be selected and maintained to ensure that the maximum temperature for the efficient operation of the catalyst beds are not exceeded. A control system for the heat transfer section may be used incorporating sensors supplying the data concerning the temperature of the process flow to a heat transfer controller. Using this data, the controller may modify the cooling rate of the heat transfer system to provide the desired process flow temperatures or temperature ranges.

In another aspect, the first and second catalyst beds and the heat transfer section are combined within a single substantially liquid-phase reaction vessel to provide a compact substantially liquid-phase reaction zone with the ability to internally manage temperatures without introducing or blending additional and external sources of vapor or liquid components into the process fluids. Thus, the methods and systems of such aspects having a hydrogen consumption below about 500 SCF/B generally avoid having to dilute the hydrocarbon stream with diluents and other temperature control fluids, which can have undesired effects on the reactions and result in undue complexity to the hydroprocessing unit.

In another aspect, the methods and system herein provide a feed stream to a first substantially liquid-phase reaction zone to undertake hydroprocessing of the feed. The feed stream may include an admixture of hydrocarbons and an amount of hydrogen in excess of the hydrogen consumed in the substantially liquid-phase reaction zone. The hydrocarbons are then hydroprocessed in the first and second catalyst beds under substantially liquid-phase conditions to produce an effluent stream. The effluent from the first reaction zone then may be directed to one or more additional substantially liquid phase reaction zones for further sequential hydroprocessing treatments. The use of multiple reaction zones permits more gradual treatment of the hydrocarbon stream (reducing temperature concerns) and greater process flexibility.

In yet another aspect, each catalyst bed may include one or more hydroprocessing catalysts and each bed has an inlet and exit temperature, as well as a maximum operating temperature limit or range for the effluent operation of the catalyst system. To maintain reaction temperatures below these maximum operating temperature ranges, sufficient heat is removed from the hydrocarbons via the internal heat transfer section. To this end, a heat transfer section may be mounted in the reaction vessel between each of the catalyst beds to receive the reacted process effluent from the previous catalyst bed, and to reduce the temperature of the effluent by transferring heat to a fluid. A heat transfer section is positioned to provide the temperature reduced process fluid to the first and second catalyst beds or any existing subsequent beds all within the same reaction vessel. In this aspect, the maximum operating temperature of the catalyst beds is maintained below a maximum temperature threshold necessary to maintain the desired reaction activity, without the use of added diluents or quench streams, which can reduce the effectiveness of the particular reactions.

In another aspect, heat transfer section is configured within the reaction vessel to substantially maintain the hydrocarbon flow exiting the first catalyst bed at a temperature below the maximum operating temperature range of the hydroprocessing catalysts in the second bed. Accordingly, the hydrocarbon flow through the second catalyst bed also is below the maximum operating range. The same or an additional heat transfer section also may be configured to provide the hydrocarbon flow to the second catalyst bed at temperature selected such that the outlet temperature from the second bed does not exceed the maximum operating temperature range of the hydroprocessing catalyst in the second bed. The temperatures of the hydrocarbon flow in such aspects also may be measured at the inlet or outlet of the catalyst bed, or both locations.

In yet another aspect of the method and system, the resulting effluent stream is directed to an enhanced separation zone configured to separate a hydrogen rich-vaporous stream from a liquid product stream. In the enhanced separation zone, a stripping medium including very high pressure steam, such as steam at 1200 to 1600 psig, is introduced into the separation zone to effect separation of the hydrogen and other components such as hydrogen sulfide, ammonia, methane, ethane, propane and butanes from the liquid product stream. The very high pressure steam separation provide a more removal of such vapor components. In such aspects, the thermal input used to generate the high pressure steam in most instances is not readily available to hydroprocessing systems. The heat transfer section(s) from the above discussed reaction zones, however, may be used to provide, in significant part, the necessary thermal input to generate the high pressure steam from the heat generated in and removed from the hydroprocessing zones.

Other embodiments encompass further details of the process, such as preferred feed stocks, catalysts, and operating conditions to provide but a few examples. Such other embodiments and details are hereinafter disclosed in the following discussion of various aspects of the process.

DETAILED DESCRIPTION

Figure 1:
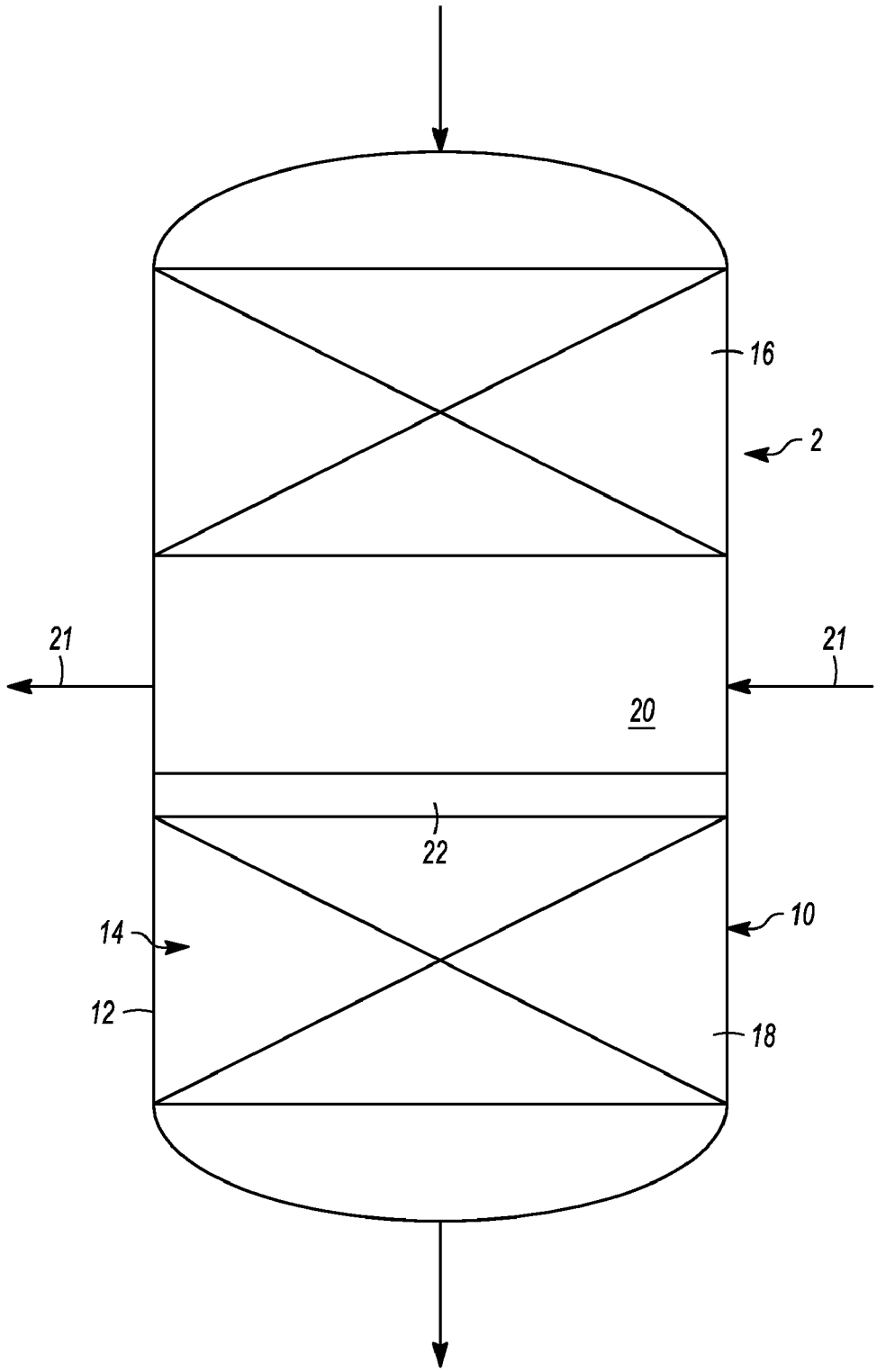
FIG. 1 is a schematic view of an exemplary hydroprocessing vessel.

In general, hydroprocessing systems and methods described herein are particularly useful for hydroprocessing a hydrocarbonaceous feed stock containing hydrocarbons and/or other organic materials to produce a product containing hydrocarbons and/or other organic materials of lower average boiling point, lower average molecular weight, and/or reduced concentrations of contaminants, such as sulfur and nitrogen and the like. In one aspect, the systems and methods use a substantially liquid-phase reaction zone with internal temperature management that eliminates, or substantially reduces, the need for the introduction of diluents or quench streams or additional fluids into the feed stream to the reaction zone to assist in managing the temperature of the feed and reaction zone. Accordingly, the systems and methods may operate without, or may operate with substantially reduced, recycle gases added to the feed stream, recycle gas compressors, liquid quench streams, and, in many instances, liquid recycle streams to manage the temperatures in the reaction zone.

In such an aspect, the substantially liquid-phase reaction zone typically includes one or more reactor vessels with at least a first and second catalyst beds. The substantially liquid-phase hydroprocessing zone may be a substantially liquid-phase hydrotreating zone, hydrocracking zone, hydroisomerization zone, hydrodenitrification zone, hydrodeoxygenation zone, and an olefin saturation zone to suggest but a few examples.

In one aspect, before the liquid feed stream is introduced into the substantially liquid-phase hydroprocessing zone, the liquid feed stream is mixed with an amount of hydrogen provided from a make-up hydrogen system to provide a source of hydrogen for the hydroprocessing reactions. In such an aspect, the temperature of the liquid feed stream to the substantially liquid-phase hydroprocessing zone may be modified by the hydrogen make up stream or by other hydroprocessing streams admixed with the liquid feed stream. With this approach, the other pre-reactor streams may be used to reduce the temperature of the process stream such that the temperature of the process stream over the first catalyst bed does not exceed the maximum temperature range for the efficient operation of the first catalyst bed. In such aspects, a heat transfer section would not necessarily be required (although it could be used) at the inlet to the first catalyst bed.

In another aspect of the system, an integral heat transfer section is mounted between the catalyst beds to modify and control the temperatures internal to the reactors. In this aspect, both of the catalyst beds and the integral heat transfer section are combined in the single reaction vessel providing a compact and integrated system. In this aspect, the integral heat transfer section may be mounted in a position to receive a process effluent from the first catalyst bed. The fluid from the first catalyst bed circulates through the heat transfer section to exchange heat with a transfer fluid separate from the hydrocarbon stream and then exits to the second catalyst bed. In such aspects, the heat transfer section is provided with a control system, which may be a manual or a microprocessor controlled system that receives data from sensors monitoring the temperatures of the effluent. Using this data, the adjustments to the heat transfer section, such as increasing or decreasing the heat transfer media flow rate or temperature, may be made to modify the effluent temperature or temperature ranges. The heat transfer media may be, but is not limited to, preheated boiler feed water undergoing generation to steam, saturated steam undergoing superheating, a process fluid internal to the hydroprocessing system, or other such media that provide heat transfer capability.

In another aspect, the heat transfer section also may include a recollection and redistribution chamber or manifold mounted at exit of the heat transfer section to collect and to redirect the cooled effluent flow into the second catalyst bed. In such an aspect, the heat transfer section comprises a tubular heat exchange bundle mounted within the reactor shell positioned to receive the effluent from the first catalyst bed. Other suitable heat exchange systems known to those skilled in the art that prevent contact between the effluent flow and the transfer liquid, and that also will efficiently transfer heat from the effluent flow also may be adapted for use in the heat transfer system.

In yet another aspect, a heat transfer section is positioned in the reactor and is configured to simultaneously manage both the temperature of the process flow through the first catalyst bed and the process flow through the second catalyst bed to maintain the process flow temperatures over the catalyst beds below the catalyst bed maximum temperature ranges. In such an aspect, the reactor may include a heat transfer section before the first catalyst bed and between the catalyst beds. The temperature of the process flow as it enters the catalyst beds may be selected taking into account the heat generated in the catalyst bed due to the processing of the effluent over the catalyst bed. The temperature of the process flow as it enters the bed is sufficiently reduced to ensure that the overall temperature of the process flow and catalyst bed does exceed the catalyst bed maximum temperatures as reflected by the process flow temperature at the outlet of the catalyst beds.

The process flow temperatures may be monitored at the inlets or exits (or both) of the catalyst beds to provide temperature data to the control system for the heat transfer system. The data input permits adjustment of the process flow temperatures at the inlets to the catalyst beds in respond to temperature changes in the bed as reflected in the process flow exit temperatures. In other systems, temperature sensors may be located proximate to the catalyst beds to monitor the temperature of the beds and the process flow through the bed to provide further data for the selection of the catalyst bed input temperatures.

In still another aspect, the system and method may be used with reactors having one more or additional catalyst beds, with heat transfer systems between each bed. The system also may include multiple reactors in series or in parallel, with each reactor containing one or more catalyst bed and heat transfer systems. In such systems, each catalyst bed in each reactor may provide a different treatment to the process flow, or they may provide incremental treatments to the flow, while maintaining the temperatures in or over each bed below the maximum temperature or temperature range for the efficient operation of the catalyst bed.

In some aspects of such systems and methods, hydrocarbonaceous feed stocks may be subjected to hydroprocessing by the methods disclosed such as mineral oils and synthetic oils (e.g., shale oil, tar sand products, etc.) and fractions thereof. Illustrative hydrocarbon feed stocks include those containing components boiling above about 288° C. (550° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. In one aspect, a preferred feed stock is a gas oil or other hydrocarbon fraction having at least about 50 weight percent, and preferably at least about 75 weight percent, of its components boiling at a temperature above about 371° C. (700° F.). For example, one preferred feed stock contains hydrocarbon components which boil above about 288° C. (550° F.) with at least about 25 percent by volume of the components boiling between about 315° C. (600° F.) and about 565° C. (1050° F.). Other suitable feed stocks may have a greater or lesser proportion of components boiling in such range.

In one particular example, the hydroprocessing reaction zone may be a hydrotreating zone configured to produce a first effluent including hydrogen sulfide and ammonia. In such a system, the reaction zone conditions may include a temperature from about 204° C. (400° F.) to about 482° C. (900° F.), a pressure from about 3.5 MPa (500 psig) to about 16.5 MPa (2400 psig), a liquid hourly space velocity of the fresh hydrocarbonaceous feed stock from about 0.1 $hr^{-1}$ to about 10 $hr^{-1}$ with a hydrotreating catalyst or a combination of hydrotreating catalysts. Other conditions may also be used depending on the specific feeds, catalysts, and composition of the effluent stream desired.

In the above hydrotreating example, the added hydrogen is dissolved in the liquid feed stream and used in the presence of a suitable catalyst(s) that is primarily active for the removal of heteroatoms, such as sulfur and nitrogen, from the hydrocarbon feed stock. In one aspect, suitable hydrotreating catalysts for use in the present invention are conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina.

Other suitable hydrotreating catalysts include zeolitic catalysts, as well as noble metal catalysts where the noble metal is selected from palladium and platinum. In another aspect, more than one type of hydrotreating catalyst may be used in the same reaction vessel. In such aspect, the Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

In yet another aspect of the methods and system, the liquid feed stream to the substantially liquid-phase hydrotreating zone may be saturated with at least hydrogen prior to being introduced to the substantially liquid-phase reaction zones. Preferably, the hydrogen is provided in an amount in excess of that required to saturate the liquid such that the liquid in the substantially liquid-phase hydrotreating reaction zone also has a small vapor phase throughout.

In one such aspect, an amount of hydrogen is added to the feed stream sufficient to maintain a substantially constant level of dissolved hydrogen in the liquid throughout the liquid-phase reaction zone as the reaction proceeds. Thus, as the reaction proceeds and consumes the dissolved hydrogen, there is sufficient additional hydrogen in the small gas phase to continuously provide additional hydrogen to dissolve back into the liquid-phase in order to provide a substantially constant level of dissolved hydrogen (such as generally provided by Henry's law, for example). The liquid-phase in the reaction zone, therefore, remains substantially saturated with hydrogen even as the reaction consumes dissolved hydrogen. Such a substantially constant level of dissolved hydrogen is advantageous because it provides a generally constant reaction rate in the liquid-phase reactors and can overcome the hydrogen depletion that can be a problem in prior liquid-phase systems that only saturate the liquid stream with hydrogen.

In such aspects, the amount of hydrogen will preferably range from about 100 to about 150 percent of saturation and, in other cases, range from about 125 to about 150 percent of saturation. In yet other examples, it is expected that the amount of hydrogen may be up to about 500 percent of saturation to about 1000 percent of saturation. In some cases, the substantially liquid-phase hydrotreating zone will generally have hydrogen in excess greater than about 10 percent of the hydrogen consumed by chemical reactions and, in other cases, have hydrogen in excess greater than about 25 percent hydrogen gas of the hydrogen consumed by chemical reactions by volume of the reactors in the hydrotreating zones.

At the substantially liquid-phase hydrotreating conditions discussed above, it is expected that about 100 to about 800 SCF/B of hydrogen will be added to the liquid feed stream to the substantially liquid-phase hydrotreating zone in order to maintain the substantially constant saturation of hydrogen throughout the liquid-phase reactor to enable the hydrotreating reactions. It will be appreciated, however, that the amount of hydrogen added to the feed can vary depending on the particular hydroprocessing reactions, feed composition, operating conditions, desired output, and other factors.

It should be appreciated, however, that the relative amount of hydrogen while maintaining a substantially liquid-phase system, and the preferred additional hydrogen thereof, is dependent upon the particular hydroprocessing reaction, the specific composition of the hydrocarbonaceous feed stock, the desired conversion rates, and/or the reaction zone temperature and pressure. The appropriate amount of hydrogen required will depend on the amount necessary to provide a liquid-phase system, and the preferred additional hydrogen thereof, once all of the above-mentioned variables have been selected.

The effluent from the substantially liquid-phase reaction zone is preferably directed to a separation zone, such as a high pressure flash vessel, where the hydrogen and vaporous contaminants, such as ammonia and hydrogen sulfide are removed. Because the reaction vessel operates in a substantially liquid phase condition, the hydrogen and any vaporous contaminants tend not to be effectively separated in a flash drum at the pressures and temperatures of the reaction vessel. Therefore, in another aspect, the separation zone is preferably an enhanced separation zone using an introduced stripping medium to effect the desired separations.

By one approach, the separation vessel operates at a temperature from about 232° C. (450° F.) to about 468° C. (875° F.), a pressure from about 3.5 MPa (500 psig) to about 16.5 MPa (2400 psig) to separate such streams. This separation zone is configured to separate any vapors materials (such as gaseous hydrogen, hydrogen sulfide, ammonia, and/or C1 to C4 gaseous hydrocarbons and the like), which can then be directed to a recovery system.

To enhance the separation, the stripping medium combined with mechanical device, such as a tray or packing, is used to enhance the separation of the hydrogen and vaporous contaminants. Traditionally, hydrogen would be introduced into the separation zone to enhance the separation by reducing the partial pressure of the various contaminants desired to be removed, but since this process is a conducted under substantially liquid phase conditions, the excess hydrogen normally found in the recycle gas streams is not available for use. Another aspect of this method utilizes steam and preferably high pressure steam into the separation zone to enhance the separation. By one approach, steam at 1,200 to 1,600 psi is introduced into the separation zone to reduce the partial pressure of the contaminants desired to be removed.

While such high pressure steam is not normally available in a refinery, in the systems described herein, the heat transfer sections of the substantially liquid-phase hydroprocessing reaction zones may be used to generate (in whole or in part) the very high pressure steam by passing steam and/or water through the heat transfer sections or by using the heat transfer media for the heat transfer section as a heating source (through a heat exchange surface) for the water and/or steam. In this manner, the heat generated by the exothermic reactions in the catalyst beds is recovered and used to generate the stripping medium to enhance the separation in the separation unit. Alternatively, the steam generated by the heat transfer unit can also be used to power a condensing turbine or other equipment. In some cases, it is expected that the net power generation may be at least 6.2 kWatt-hours per barrel of reactor charge.

In alternative aspect, a portion of the resultant liquid stream from the above described separation zone, may also be recycled back to the liquid feed stream to help provide temperature management. In some cases, when the hydrogen consumption is greater than 500 SCF/B, a small amount, such as a ratio of 0.1 to about 0.9:1 of the liquid recycle or another liquid diluent to fresh feed may optionally be combined with the feed to the substantially liquid-phase reaction zone to help maintain temperature along with the internal heat transfer section.

DETAILED DESCRIPTION OF THE DRAWING FIGURES

Referring to FIG. 1, the substantially liquid-phase reaction zone 2 may include a reactor vessel 10 having an outer shell 12 defining an internal cavity 14 therein. The reactor 10 may includes at least a first catalyst bed 16 and a second catalyst bed 18 with an integral heat transfer section 20 mounted therebetween with a suitable control system (not shown). Both catalyst beds 16 and 18 as well as the integral heat transfer section 20 are combined in the single reaction vessel 10 to provide a compact and integrated reaction system that can manage reaction temperatures without introducing external materials into the process fluids. By one approach, the integral heat transfer section 20 may be mounted within the reactor shell 12 in a position to receive a process effluent from the first catalyst bed 16. The fluid from the first catalyst bed 16 then circulates through the heat transfer section 20 to exchange heat with a transfer fluid 21 separate from the hydrocarbon stream and then exits to the second catalyst bed 18.

The liquid-phase reaction zone 2 also may provided with temperature sensors 24 that may be placed at the inlets or outlets (or both) of the catalyst beds 16 and 18 to supply temperature data to the control system. The sensors also may be located in or proximate to the catalyst beds to provide further temperature information on the process flow. In some instances, the heat transfer unit 20 may also include a recollection and redistribution chamber or manifold 22 mounted at exit of the transfer section 20 to collect and redirect the cooled fluid into the next catalyst bed 18. By one approach the reactor integral heat transfer section 20 may be a tubular heat exchange bundle mounted within the reactor shell 12 in a position to receive the effluent from the first catalyst bed. By another approach, the heat transfer section 20 is positioned in the reactor shell 12 and configured to manage both the exit temperature of the first catalyst bed 16 as well as the inlet temperature of the second catalyst bed 18 at the same time to manage the reactor temperatures below the catalyst maximum temperature ranges.

Figure 2:
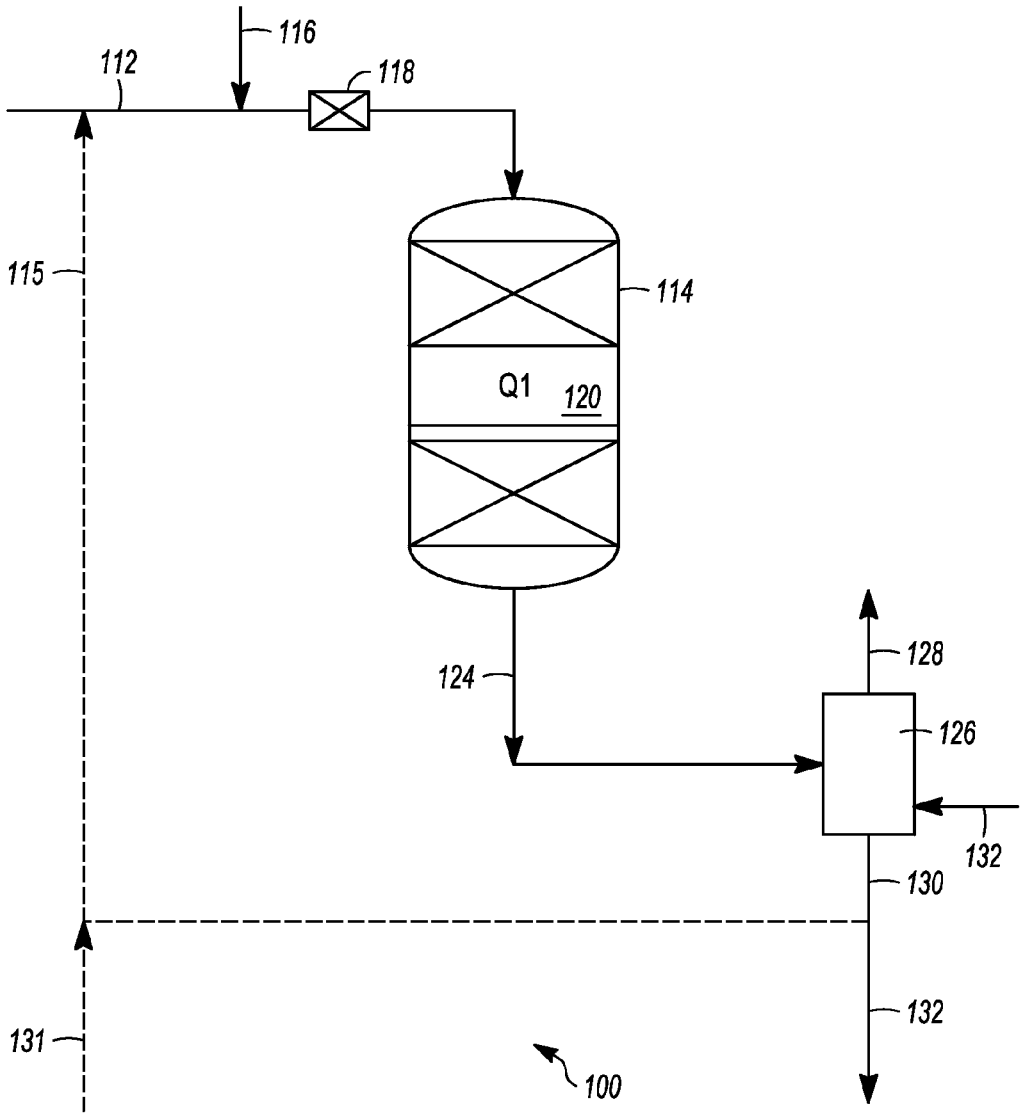
FIG. 2 is a flow chart of a hydroprocessing system.

Turning to FIG. 2, an exemplary hydroprocessing process that eliminates the use of a recycle gas compressor but still gains the efficiency of three-phase operation will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to FIG. 2, an integrated processing unit 100 is illustrated where a hydrocarbonaceous feed stock, which preferably comprises a vacuum gas oil or a heavy gas oil, is introduced into the process via line 112 and directed to a substantially liquid-phase reaction vessel 114. An optional recycle stream 115 that may be used to carry hydrogen and/or decrease the temperature rise in the zone 114 may be combined with stream 112. Hydrogen from a hydrogen-rich or pure hydrogen stream provided from line 116 is combined with the liquid feed stream 112 and optionally mixed together in a mixing device 118, which could be an on-purpose mixing device, such as a static mixer or a pipe segment that ensures mixing.

The combined and mixed feed is then reacted in the substantially liquid-phase reactor 114. The reaction classes may include, but are not limited to, selective hydro-cracking, ring saturation, ring opening, isomerization, hydrotreating, hydrodesulfurization and the like. The reactor 114 may contain a catalyst that affects a hydroprocessing classes of reactions. By one approach, a first stage or within a first catalyst bed of hydroprocessing may be conducted with a feed laden with organic sulfur and/or organic nitrogen species, and a catalyst system may chosen to perform substantial hydrodesulfurization and hydrodenitrification. In this case, this first stage of hydroprocessing would be an example of relatively sour service. The reactions in the first stage generate sufficient heat to increase the temperature of the process fluid. The heat Q1 generated in this first reaction bed may be removed by a heat exchange service 120 provided within the reactor. The cooled effluent from the first reactor bed then enters a second reactor bed within the same reactor vessel to undertake another hydroprocessing reaction, which may be the same or different than the initial hydroprocessing set of reactions.

An effluent stream is withdrawn from the reactor via line 124. The reactor effluent 124 is directed to a separation zone 126 where it is separated into a gas phase withdrawn from the separator at line 128 and a liquid phase withdrawn from the separation zone at line 130. In one aspect, the separation zone may be a hot high-pressure separator having enhanced separation that utilizes a stripping medium, such as high pressure steam, provided in stream 132. As discussed above, the separation zone may also contain some mechanical separation devices, such as trays, packing, and the like to increase the separation efficiency of the separator.

Any hydrogen sulfide and ammonia evolved in the reactor 114 are essentially removed from the liquid in the separation zone in stream 118. In this example, stream 118 may be further cooled, amine scrubbed to remove the hydrogen sulfide and ammonia, and sent to a hydrogen recovery system (not shown). In the system 100, the bottom liquid stream 130 has a sulfur and nitrogen concentration much lower than the fresh feed and may now be further processed.

Optionally, stream 130 may be split to provide the optional recycle stream 115 back to the same reaction stage. In yet another aspect, the recycle stream 115 may also be a liquid stream 131 from a downstream reaction stage. The recycle stream would likely not come from an upstream reaction stage because the liquid from an upstream stage would contain more organic sulfur and nitrogen thus defeating the purpose of the adding the recycle because it would simply add additional contaminates to the reaction zone.

The net liquid from the separation zone in stream 132 may be directed one or more similar downstream reaction stages, which may be similar to the above described reaction stage 110. If the next reaction stage is the last reaction stage, the net liquid stream 132 then goes to other flashes and/or fractionation zones.

The control system 134 for the heat transfer section 20 may be operated by a microprocessor driven system or a manual system. The control system 134 utilizes data collected from the temperature sensors 24. The control system 134 is used to adjust the cooling rate of the heat transfer section 20 to increase of decrease the temperature of the process follow based on the temperature data by, for example, increase or decreasing the flow rate or temperature of the transfer fluid flow 21.

The foregoing description of the drawing clearly illustrates the advantages encompassed by the processes described herein and the benefits to be afforded with the use thereof. In addition, FIGS. 1 and 2 are intended to illustrate but one exemplary flow scheme of the processes described herein, and other processes and flow schemes are also possible. It will be further understood that various changes in the details, materials, and arrangements of parts and components which have been herein described and illustrated in order to explain the nature of the process may be made by those skilled in the art within the principle and scope of the process as expressed in the appended claims.

What is claimed is:

1. A method of hydroprocessing hydrocarbons comprising:

providing a substantially liquid-phase reaction zone having first and second catalyst beds in liquid communication, and a heat transfer section positioned in liquid communication with the catalyst beds; each catalyst bed having a maximum operating temperature range;

providing a hydrocarbonaceous feed stream to the substantially liquid phase reaction zone, the hydrocarbonaceous feed stream including an admixture of the hydrocarbons and an amount of hydrogen effective to provide a hydrogen supply for the substantially liquid-phase reaction zone, and the liquid-phase reaction zone having a substantially continuous liquid-phase throughout;

hydroprocessing the hydrocarbons in the first and second catalyst beds under substantially liquid-phase conditions to produce an effluent stream;

passing the hydrocarbon process flow through the heat transfer section and removing sufficient heat from the hydrocarbon process flow to maintain the hydrocarbon process flow over each catalyst beds at or below the maximum operating temperature range of the hydroprocessing catalyst bed;

directing the effluent stream to a separation zone configured to separate a vaporous stream from the liquid product stream; and introducing a stripping medium including high pressure steam at 1200 to 1600 psig into the separation zone to effect separation of the vaporous stream from the liquid product stream.

2. The method of claim 1, wherein the first and second catalyst beds and the heat transfer section are combined in the same reaction vessel, and the temperature of the hydrocarbon process flow into the first and second catalyst beds are selected such that the temperature of the process flow at the outlet of the beds are below maximum operating temperature range of the hydroprocessing catalyst beds.

3. The method of claim 1, wherein the heat transfer section comprises heat transfer fluid separated from the hydrocarbon process flow and directed to a generator for the high pressure steam.

4. The method of claim 3, wherein the high pressure steam is used to generate power with a power generating device such as, but not limited to, a steam condensing turbine.

5. The method of claim 1, wherein the substantially liquid-phase reaction reactor operates without a liquid recycle stream.

6. The method of claim 1, wherein the substantially liquid-phase reactor operates without additional sources of hydrocarbons introduced to the reaction vessel to reduce temperatures within the catalyst beds.

7. The method of claim 1, wherein substantially liquid-phase reactor includes at least about 10 percent excess hydrogen above the chemical hydrogen consumption requirements.

8. A method of hydroprocessing a hydrocarbonaceous stream comprising:

providing a substantially liquid-phase reaction zone having first and second catalyst beds in fluid communication with a heat exchange section therebetween, the first and second catalyst beds and the heat exchange section combined within the same reaction vessel, and each catalyst bed having a hydroprocessing catalyst therein with a maximum operating temperature range;

providing a feed stream to the reaction zone, the feed stream including an admixture of the hydrocarbonaceous stream and an amount of hydrogen effective to at least saturate the hydrocarbonaceous stream, the substantially liquid-phase reaction zone in a substantially continuous liquid-phase throughout;

hydroprocessing the hydrocarbons in the first and second catalyst beds under substantially liquid-phase conditions to produce an effluent stream having an amount of hydrogen dissolved therein;

passing the hydrocarbon process flow through the heat transfer section and removing sufficient heat from the hydrocarbon process flow to maintain to maintain a temperature of the hydrocarbon process flow in at least the second catalyst bed at or below the maximum operating temperature range of the hydroprocessing catalyst bed; and directing the effluent stream from the reaction zone to a separation zone to separate a vaporous stream from a liquid product stream using a stripping medium including high pressure steam at about 1,200 to about 1,600 psig to enhance the separation of the hydrogen from the liquid product stream.

9. The method of claim 8, wherein the heat exchange section of the reaction vessel generates the high pressure steam.

10. The method of claim 8, wherein substantially liquid-phase reaction zone includes at least about 10 percent excess hydrogen above the chemical hydrogen consumption requirements.

11. The method of claim 8, wherein the substantially liquid-phase reaction zone operates without a recycle stream.

12. The method of claim 8, wherein the substantially liquid-phase reaction zone operates without external sources of hydrocarbons introduced to the reaction vessel.

* * * * *